United States Patent [19]

Griggs, Jr.

[11] Patent Number: 4,506,926

[45] Date of Patent: Mar. 26, 1985

[54] RECLINING CHAIR WITH PUSH-BUTTON ACTUATOR MECHANISM

[75] Inventor: Alvie Griggs, Jr., Okolona, Miss.

[73] Assignee: PeopLoungers, Inc., Nettleton, Miss.

[21] Appl. No.: 482,021

[22] Filed: Apr. 4, 1983

[51] Int. Cl.[3] ..... A47C 1/02

[52] U.S. Cl. ..... 297/83; 297/68; 297/84

[58] Field of Search ..... 297/68, 83, 84, 85, 297/88, 89, 90, 69, 70, 71

[56] References Cited

U.S. PATENT DOCUMENTS

| | | | |
|---|---|---|---|
| 255,908 | 4/1882 | Allen | 297/368 |
| 972,334 | 10/1810 | Casassa | 297/369 |
| 1,924,329 | 8/1933 | Pasternack et al. | 297/370 |
| 3,131,965 | 5/1964 | Mouler | 297/DIG. 7 |
| 3,295,885 | 1/1967 | Barksdale | 297/84 |
| 4,185,870 | 1/1980 | Johnson | 297/84 |
| 4,226,468 | 10/1980 | Johnson | 297/84 |
| 4,291,913 | 9/1981 | Kowalski | 297/89 |
| 4,352,523 | 10/1982 | Holobaugh, Jr. | 297/68 X |

FOREIGN PATENT DOCUMENTS

| | | | |
|---|---|---|---|
| 611178 | 12/1960 | Canada | 297/83 |
| 960571 | 1/1975 | Canada | 297/DIG. 7 |

*Primary Examiner*—James T. McCall

*Attorney, Agent, or Firm*—Watson, Cole, Grindle & Watson

[57] ABSTRACT

A push-button actuator mechanism for actuating a control link of a carriage mechanism in a reclining chair so as to cause the chair to be repositioned from an upright positioning to a reclining positioning includes an actuator arm which is spring biased to move a drive arm that is connected to the control link, and a pivotally mounted hawkbill latch arm which has a curved lip at one of its ends that is capable of controlling the movement of the actuator arm and a manually operable push button at its opposite end that extends outwardly through the material forming the outer lateral side of one of the chair's sides.

8 Claims, 6 Drawing Figures

RECLINING CHAIR WITH PUSH-BUTTON ACTUATOR MECHANISM

BACKGROUND OF THE INVENTION

1. Field of the Invention

The present invention relates to reclining chairs, and more particularly to reclining chairs which include actuator assemblies which, when operated by the user of the chair, will activate the mechanical support mechanisms in the chairs so as to reposition them from an upright to a reclined positioning.

2. The Prior Art

Chairs which are constructed such that the backrest part thereof can be tilted with respect to the seat part by one or more hand-operated levers connected to support mechanisms inside the chair are well known. See, for example, U.S. Pat. Nos. 255,908, 972,334 and 1,924,329. Also well known are the more modern reclining chairs which are constructed with complicated mechanical support mechanisms operable such that all the major parts of the chair, i.e., the backrest, seat, footrest and chair sides, will be repositionable with respect to each other and with respect to a chair base therebelow, thereby changing the positioning of the chair from an upright positioning to a reclined positioning and vice versa, based on the wishes of the user. See, for example, U.S. Pat. Nos. 4,185,870, 4,226,468 and 4,352,523. Some of these modern reclining chairs also include actuator assemblies which are connected to the carriage mechanisms in the chairs and are operable by the user of the chair to activate the actuator assemblies so as to automatically reposition the chair from an upright positioning to a reclined positioning. See, for example, U.S. Pat. No. 4,352,523. However, these known actuator assemblies have been discovered to be difficult to operate, complicated in construction, subject to quick failure and/or expensive to manufacture.

Thus, it is an object of the present invention to provide an actuator assembly for a modern reclining chair (i.e., a chair of the type which includes a carriage mechanism which is capable of simultaneously moving the backrest, seat, footrest and chair sides with respect to each other and the chair base) which can be easily operated by the person sitting in the chair, which will be simple in construction, which will be durable in use, and inexpensive to manufacture and install. It is also an object of the present invention to provide a reclining chair which includes such an actuator assembly.

SUMMARY OF THE INVENTION

According to the present invention, an actuator assembly which satisfies all of the noted objects is provided in the form of a spring-assisted push-button actuator mechanism which is attachable to the front stump of one side of the reclining chair, the push-button actuator mechanism including a button which extends outwardly through the material forming the outer lateral side of one of the chair's sides and which can be easily pushed by the person sitting in the chair to operate the actuator mechanism and thus activating the carriage mechanism in the chair, i.e. without the need for any additional effort on the part of the person sitting in the chair.

More specifically, the inventive push-button actuator mechanism includes an actuator arm which is spring biased to move a drive arm which is connectable to a control link of the carriage mechanism in the reclining chair such that the carriage mechanism will move the seat, backrest, footrest and chair sides relative to each other and to a chair base, and thus cause the chair to be repositioned from an upright positioning to a reclined positioning. The push-button actuator mechanism also includes a hawkbill latch arm which includes a button at one end and a curved lip at the other end which is capable of controlling the movement of the actuator arm and thus the operation of the push-button actuator mechanism as a whole.

A further understanding of the present invention will be achieved by reference to the accompanying drawings, taken in conjunction with the following discussion.

DETAILED DESCRIPTION OF THE PREFERRED EMBODIMENT

Figure 1:
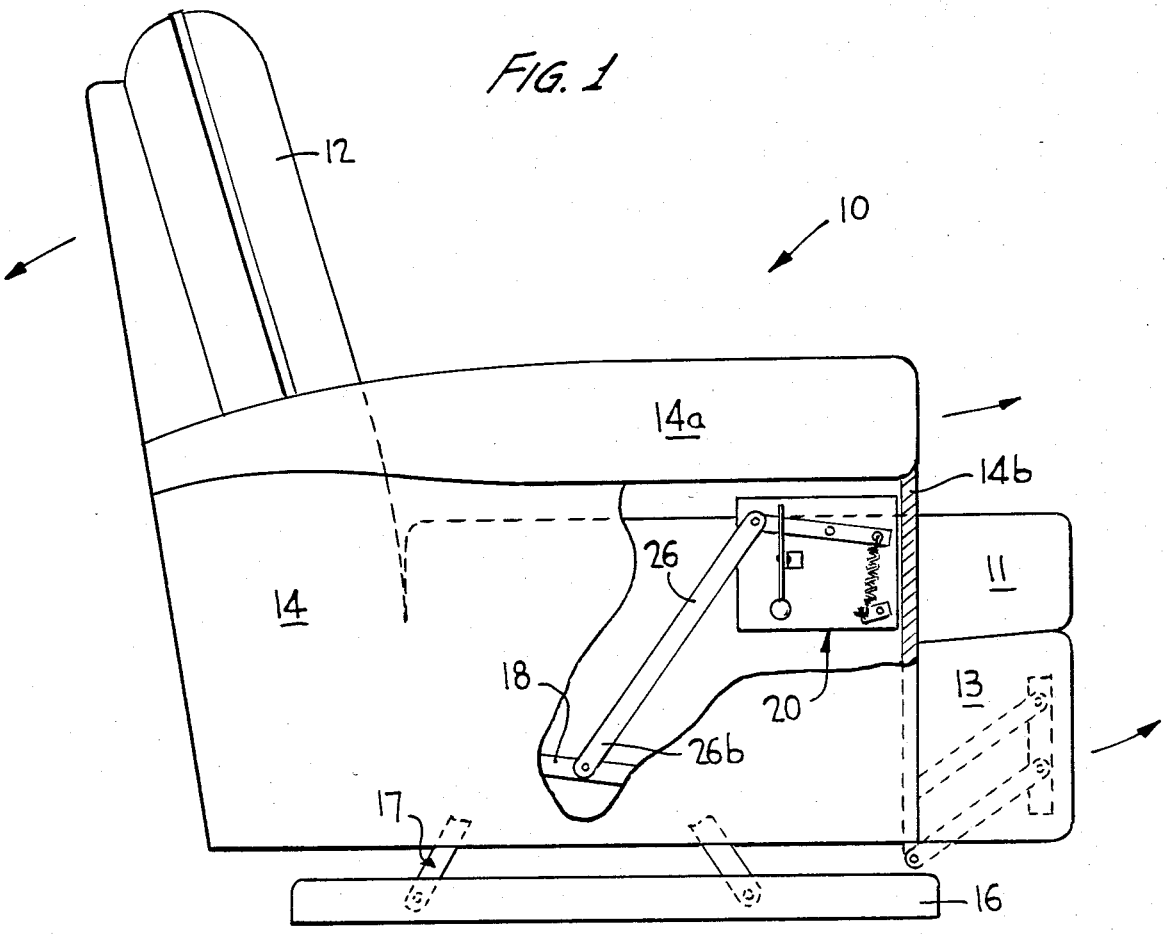
FIG. 1 shows a schematic side view of a reclining chair which includes a push-button actuator mechanism constructed according to a preferred embodiment of the present invention, the reclining chair being shown in an upright positioning.
Figure 2:
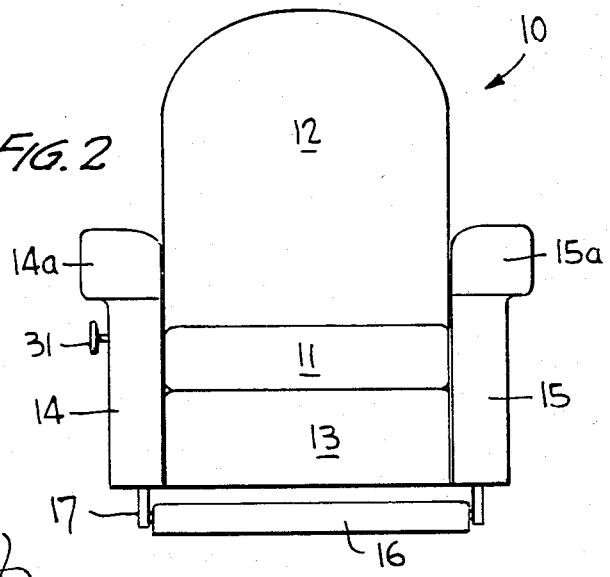
FIG. 2 shows a schematic front view of the reclining chair of FIG. 1.
Figure 3:
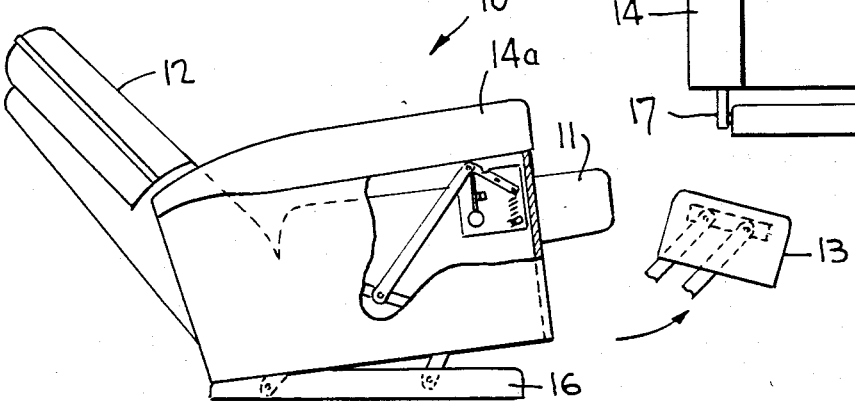
FIG. 3 shows a schematic side view of the reclining chair of FIG. 1 when in a partially reclined positioning.

A reclining chair which includes a push-button actuator mechanism constructed according to a preferred embodiment of the present invention is shown in FIGS. 1, 2 and 3. The reclining chair, generally labeled 10, includes a seat 11, a backrest 12, a footrest 13, opposite chair sides 14 and 15 (these chair sides 14 and 15 providing armrests **14*a* and 15*a* at their upper ends), a chair base 16 and a carriage mechanism 17 (not shown in detail). The carriage mechanism 17 acts to support all of the aforementioned parts of the reclining chair above the chair base 16 and enables them to move relative to each other and to the chair base in a known way when the reclining chair is activated by the user so as to be repositioned from an upright positioning (FIG. 1) to a reclined positioning (FIG. 3**), and vice versa. A typical carriage mechanism of this type is, for example, shown in U.S. Pat. No. 4,352,523.

The inventive push-button actuator mechanism, generally labeled 20, is for the most part mounted within the chair side 14 so as to be hidden from view, i.e., by the material forming the lateral sides of the chair side 14. However, as seen in FIG. 2 a button portion of the push-button actuator mechanism will protrude through the material forming the outer lateral side of the chair side 14. This button, when pushed inwardly, i.e., toward the chair side 14 by the user of the chair (i.e., with his right hand), will initiate operation of the push-button actuator mechanism, such that the carriage mechanism 17 will be activated to reposition the reclining chair from its upright positioning (FIG. 1) to a reclined positioning (FIG. 3) in a fashion which will be discussed in more detail below.

Figure 6:
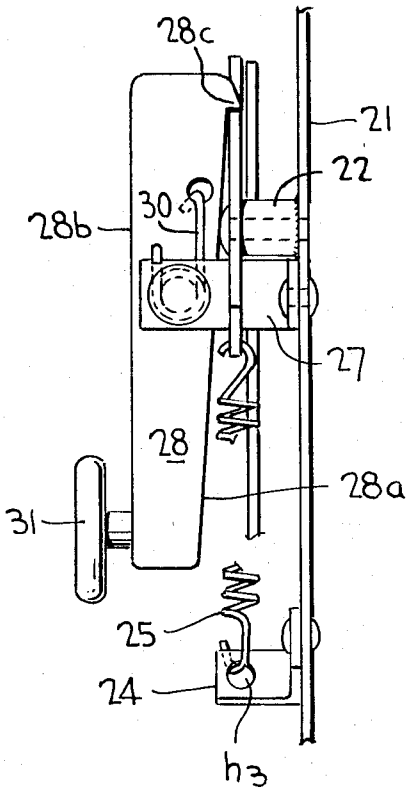
FIG. 6 shows an end view of the inventive push-button actuator mechanism as seen along line 6—6 in FIG. 4.
Figure 4:
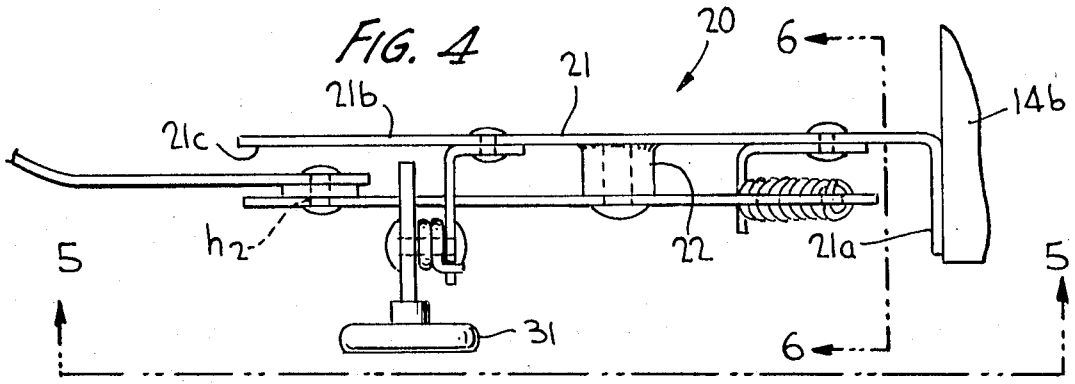
FIG. 4 shows a plan view of the inventive push-button actuator mechanism utilized in the reclining chair of FIG. 1.
Figure 5:
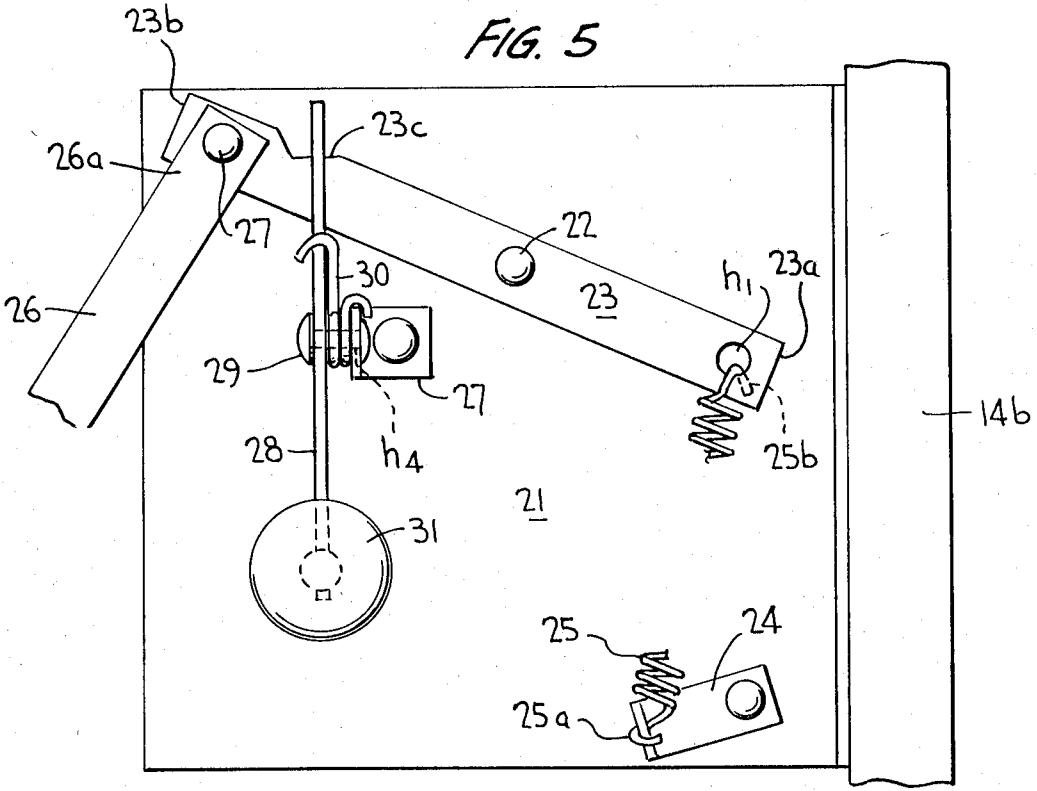
FIG. 5 shows a side view of the inventive push-button actuator mechanism as seen along line 5—5 in FIG. 4.

Considering the inventive push-button actuator mechanism in more detail, as seen in FIGS. 4–6 it includes a support plate 21 which has a side portion 21*a* that can be connected by suitable means (not shown) to the front stump 14*b* of the chair side 14 in such a fashion that the main portion 21*b* of the support plate 21 will essentially extend towards the rear of the chair in parallel with the chair sides 14 and 15. A pin bracket 22 is fixedly connected to the support plate 21 so as to extend perpendicularly away from the side 21*c* of the support plate which faces outwardly of the chair 10, and an actuator arm 23 is pivotally mounted on the pin bracket 22 so as to be rotatable in a plane essentially parallel to a plane defined by the main portion 21*b* of the support plate 21. This actuator arm includes a hole $h_1$ near its first end 23*a* (the right end of the actuator arm as seen in FIG. 5) and a hole $h_2$ near its second end 23*b* (see FIG. 4). It also includes a step-like indentation 23*c* on its upper side near its second end 23*b*, the purpose of which will become apparent below.

Also fixedly connected to side 21*c* of the support plate 21 is an L-shaped anchoring bracket 24, its point of connection to the support plate 21 being below the first end 23*a* of the actuator arm 23 (when the actuator arm is horizontally oriented). A hole $h_3$ is provided in the flange part of the L-shaped anchoring bracket 24 which extends away from the support plate 21. Connected between the anchoring bracket 24 and the first end 23*a* of the actuator arm 23 is a helical spring 25, the helical spring including a first (lower) hook portion 25*a* which extends through the hole $h_3$ in the flange part of anchoring bracket 24 and a second (upper) hook portion 25*b* which extends through the hole $h_1$ in the actuator arm 23. The helical spring 25 provides an operational bias on the actuator arm 23 such that it tends to rotate in a clockwise fashion (as seen in FIG. 5) about the pin bracket 22.

As can be best seen in FIGS. 1 and 5, connected between the second end 23*b* of the actuator arm and a control link 18 of the carriage mechanism 17 is a drive arm 26. The upper end 26*a* of the drive arm is pivotally connected to the second end 23*b* of the actuator arm by a rivet 27 which extends through the hole $h_2$, while the lower end 26*b* is pivotally connected to the control link 18. Clockwise movement of the actuator arm 23 about the pin bracket 22 will cause the drive arm 26 to be moved generally upwardly and forwardly with respect to the chair base 16, and because the drive arm is pivotally connected to the control link 18, the carriage mechanism 17 will be concurrently activated so as to reposition the elements 11–13 of the chair 10, i.e., such that the chair 10 will become repositioned from its upright positioning to a reclined positioning (in a known fashion).

Also fixedly connected to the side 21*c* of the support plate 21 is an L-shaped anchoring bracket 27, its point of connection to the support plate 21 being somewhat below the left side (as seen in FIG. 5) of the actuator arm 23 (when the actuator arm is horizontally oriented). A hole $h_4$ is provided in the flange part of the anchoring bracket 27 which extends away from the support plate 21. A hawkbill latch arm 28 is pivotally connected along its length to the flange part of the anchoring bracket 27 by a rivet 29 which extends through the hole $h_4$, so as to be movable in a plane generally perpendicular to the plane in which the actuator arm moves. A torsional spring 30 is connected between the hawkbill latch arm 28 and the anchoring bracket 27 so as to provide an operational bias on the hawkbill latch arm 28 such that it tends to rotate in a clockwise fashion about the anchoring bracket 27 (see FIG. 6). The hawkbill latch arm 28 includes a curved lip 28*c* which extends towards the support plate 21 from the upper end of its side 28*a*, and it also mounts a button 31 at the lower end of its opposite side 28*b*, the button 31 extending in a direction away from the support plate 21. The curved lip 28*c* will be engageable with the step-like indentation 23*c* in the upper side of the actuator arm 23.

The inventive push-button actuator mechanism of the present invention operates to control the positioning of the reclining chair 10 as follows. Considering the reclining chair in an initial upright positioning as shown in FIG. 1, such that the seat 11 will be in a generally horizontal orientation, the backrest 12 will be in a nearly vertical orientation, the footrest 13 will be positioned below the seat 11, the elements of the push-button actuator mechanism 20 will be positioned as shown in FIG. 5, i.e., the curved lip 28*c* of the hawkbill latch arm 28 will be engaged in the step-like indentation 23*c* in the upper side of the actuator arm 23 and the helical spring 25 will be stretched, the curved lip 28*c* acting to prevent the actuator arm 23 from rotating clockwise about the pin bracket 22. A person then sitting in the chair 10 can, by use of his right hand which is draped over the armrest 14*a*, push the button 31 inwardly, and this will then cause the hawkbill latch arm 28 to rotate counterclockwise about the anchoring bracket 27 against the biasing action of the torsional spring 30. The curved lip 28*c* at the upper end of the hawkbill latch arm will then disengage from the step-like indentation 23*c* in the upper side of the actuator arm 23. The helical spring 25 will then cause the actuator arm 23 to rotate in a clockwise fashion about pin bracket 22, and simultaneously the drive arm 26 to be moved upwardly and forwardly with respect to the chair base 16. This likewise causes the control link 18 of the carriage mechanism 17 to move upwardly and forwardly, and consequently the carriage mechanism 17 to move the seat 11, the back 12 of the footrest 13 and the chair sides 14 and 15 relative to one another and to the chair base 16 in a known way, such that the chair will become reclined (see FIG. 3). When the person in the chair thereafter wishes to resposition the chair into its upright positioning, he (or she) can apply downward pressure on the footrest 13 using his (or her) legs, as well as rearward pressure on the seat 11 (by grasping the armrests 14*a* and 15*a* and appropriately moving his (or her) torso). This will cause the various parts of the carriage mechanism 17 to move such that the control link 18 will move the drive arm 27 downwardly and rearwardly with respect to the chair base 16. This in turn will cause the actuator arm 23 to rotate about the pin bracket 22 in a counterclockwise fashion against the bias of the helical spring 25, and, due to the biasing force of the torsional spring 30, the curved lip 28*c* of the hawkbill latch arm 28 will eventually engage again in the step-like indentation 23*c* of the actuator arm 23. At this point the reclining chair 10 will be returned to (and locked in) its initial upright positioning (FIG. 1).

Although a complete description of one embodiment of the present invention has been provided, it should be kept in mind that various modifications can be made therein and yet still be within the scope of the appended claims.

I claim:

1. A push-button actuator mechanism for use in a reclining chair that includes a seat, a backrest, a footrest, opposite chair sides, a chair base, and a carriage mechanism mounting the seat, backrest, footrest and chair sides above the chair base and enables them to move relative to each other and to the chair base so as to cause the reclining chair to be repositioned from an upright positioning to a reclined positioning and vice versa, said push-button actuator mechanism being capable of activating the carriage mechanism so as to reposition the reclining chair from its upright positioning to a reclined positioning, said push-button actuator mechanism including a support plate which is attachable to the front stump of one of said chair sides so as to extend towards the back of said reclining chair, said support plate having a side which faces outwardly of said reclining chair, a pin bracket attached to said side of said support plate, first and second anchoring brackets attached to said side of said support plate, an actuator arm pivotally connected to said pin bracket to be movable in a first plane, said actuator arm including a first end, a second end, and a step-like indentation near its second end, a first spring means connected between said first end of said actuator link and said first anchoring bracket, a drive arm pivotally connected at its first end to said second end of said actuator arm, the second end of said drive arm being pivotally connectable to a control link of said carriage mechanism, a hawkbill latch arm pivotally connected to said second anchoring bracket so as to be movable in a second plane which is generally perpendicular to said first plane, said latch arm including a first end having a curved lip projecting towards said support plate and a second end mounting a button projecting away from said support plate, said curved lip being engageable with said step-like indentation in said actuator arm, and a second spring means connected to said hawkbill latch arm to bias said hawkbill latch arm about said second anchoring bracket such that its first end tends to move towards said support plate.

2. The push-button actuator mechanism as defined in claim 1, wherein said first spring means comprises a helical spring.

3. The push-button actuator mechanism as defined in claim 1 wherein said second spring means comprises a torsional spring.

4. In a reclining chair which includes a seat, a backrest, a footrest, opposite chair sides, a chair base and a carriage mechanism mounting the seat, backrest, footrest and opposite chair sides above the chair and enables them to move relative to each other and to the chair base so as to cause the reclining chair to be repositioned from an upright positioning to a reclined positioning and vice versa, the improvement wherein said reclining chair includes a push-button actuator mechanism which is capable of operating the carriage mechanism so as to reposition the reclining chair from its upright positioning to a reclined positioning, said bush-buttom actuator mechanism including a support plate which is attachable to the front stump of one of said chair sides so as to extend towards the back of said reclining chair, said support plate having a side which faces outwardly of said reclining chair, a pin bracket attached to said side of said support plate, first and second anchoring brackets attached to said side of said support plate, an actuator arm pivotally connected to said pin bracket to be movable in a first plane, said actuator arm including a first end, a second end, and a step-like indentation near its second end, a first spring means connected between said first end of said actuator link and said first anchoring bracket, a drive arm pivotally connected at its first end to said second end of said actuator arm, the second end of said drive arm being pivotally connectable to a control link of said carriage mechanism, a hawkbill latch arm pivotally connected to said second anchoring bracket so as to be movable in a second plane which is generally perpendicular to said first plane, said latch arm including a first end having a curved lip projecting towards said support plate and a second end mounting a button projecting away from said support plate, said curved lip being engageable with said step-like indentation in said actuator arm, and a second spring means connected to said hawkbill latch arm to bias said hawkbill latch arm about said second anchoring bracket such that its first end tends to move towards said support plate.

5. In a reclining chair as defined in claim 4 wherein said first spring means comprises a helical spring.

6. In a reclining chair as defined in claim 4 wherein said second spring means comprises a torsional spring.

7. In a reclining chair as defined in claim 4 wherein one of said chair sides includes a front stump, and wherein said support plate is attached to said front stump.

8. In a reclining chair as defined in claim 7 wherein said one of said chair sides includes material forming lateral sides, and wherein said button extends through an opening in the material of the lateral side which faces outwardly of said reclining chair.

* * * * *